US011851969B2

(12) United States Patent
Tanaka et al.

(10) Patent No.: US 11,851,969 B2
(45) **Date of Patent: *Dec. 26, 2023**

(54) INVERTED DIFFUSER FOR ABRASIVE SLURRY FLOW WITH SENSOR FOR INTERNAL DAMAGES

(71) Applicant: Baker Hughes Oilfield Operations LLC, Houston, TX (US)

(72) Inventors: Fabio O. Tanaka, Houston, TX (US); Jonathan Powell, Houston, TX (US); Mahesha Udipi, Houston, TX (US); Timothy D. Fuller, Houston, TX (US); Bryan Leach, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 16 days.

This patent is subject to a terminal disclaimer.

(21) Appl. No.: 17/701,158

(22) Filed: Mar. 22, 2022

(65) Prior Publication Data

US 2022/0213756 A1 Jul. 7, 2022

Related U.S. Application Data

(63) Continuation of application No. 16/845,213, filed on Apr. 10, 2020, now Pat. No. 11,359,452.

(51) Int. Cl.

| | |
|---|---|
| ***E21B 33/068*** | (2006.01) |
| ***E21B 33/03*** | (2006.01) |
| ***E21B 47/06*** | (2012.01) |

(52) U.S. Cl.

CPC ..... *E21B 33/03* (2013.01); *E21B 47/06* (2013.01)

(58) Field of Classification Search

CPC ..... E21B 33/068; E21B 33/04; E21B 34/025; E21B 17/1007

See application file for complete search history.

(56) References Cited

U.S. PATENT DOCUMENTS

| | | | |
|---|---|---|---|
| 3,438,653 | A | 4/1969 | Fowler |
| 3,679,238 | A | 7/1972 | Putch |

(Continued)

FOREIGN PATENT DOCUMENTS

| | | |
|---|---|---|
| CN | 201818259 | 5/2011 |
| CN | 106321032 | 1/2017 |

(Continued)

OTHER PUBLICATIONS

International Search Report and Written Opinion dated Jul. 5, 2021 in corresponding PCT Application No. PCT/US2021/023625.

*Primary Examiner* — Kenneth L Thompson

(74) *Attorney, Agent, or Firm* — HOGAN LOVELLS US LLP

(57) ABSTRACT

The present disclosure is for an inverted diffuser usable in wellheads and other wellsite equipment. The inverted diffuser includes at least one first section having a first vertical inner surface, a first inclined inner surface relative to the first vertical inner surface, and one or more channels supporting one or more releasable fasteners between the at least one first section and a wall of a wellhead or of a wellsite equipment. At least one second section is press-fitted or fastened adjacent to the at least one first section. A method for application of the inverted diffuser in a wellhead and in other wellsite equipment is also disclosed, along with a method of manufacture of the inverted diffuser.

20 Claims, 10 Drawing Sheets

(56) References Cited

U.S. PATENT DOCUMENTS

| | | | | |
|---|---|---|---|---|
| 4,179,991 | A | 12/1979 | Echols | |
| 5,141,055 | A * | 8/1992 | Chien | E21B 43/24 166/57 |
| 5,149,143 | A | 9/1992 | Howell | |
| 6,899,172 | B2 | 5/2005 | McLeod | |
| 7,051,817 | B2 * | 5/2006 | Shaposhnikov | E21B 43/121 166/372 |
| 7,628,201 | B2 | 12/2009 | McGuire | |
| 7,934,546 | B2 | 5/2011 | McGuire | |
| 8,820,400 | B2 | 9/2014 | McGuire | |
| 9,211,547 | B2 * | 12/2015 | Latta | B07B 7/02 |
| 9,290,154 | B2 * | 3/2016 | Berg | B60R 25/043 |
| 9,816,367 | B2 * | 11/2017 | Arellano | E21B 43/121 |
| 10,408,026 | B2 * | 9/2019 | Haley | E21B 43/121 |
| 10,669,805 | B1 | 6/2020 | Clay | |
| 11,359,452 | B2 * | 6/2022 | Tanaka | E21B 33/03 |
| 2008/0035326 | A1 | 2/2008 | Cherewyk | |
| 2016/0160605 | A1 | 6/2016 | Ross | |

FOREIGN PATENT DOCUMENTS

| | | |
|---|---|---|
| JP | 2004052283 | 2/2004 |
| KR | 101031418 | 4/2011 |

* cited by examiner

INVERTED DIFFUSER FOR ABRASIVE SLURRY FLOW WITH SENSOR FOR INTERNAL DAMAGES

CROSS REFERENCE TO RELATED APPLICATIONS

This application is a Continuation of U.S. patent application Ser. No. 16/845,213 titled "INVERTED DIFFUSER FOR ABRASIVE SLURRY FLOW WITH SENSOR FOR INTERNAL DAMAGES," filed Apr. 10, 2020, and which issued as U.S. Pat. No. 11,359,452 on Jun. 14, 2022, the full disclosure of which is incorporated herein by reference herein for all intents and purposes.

BACKGROUND

1. Field of Invention

This invention relates in general to equipment used in the hydrocarbon industry, and in particular, to an inverted diffuser having at least one releasable section to mix and guide abrasive slurries in a wellhead or other wellsite equipment.

2. Description of the Prior Art

A fracturing tree with a fracturing wellhead may be used in a fracturing process to assist in hydrocarbon production from subterranean environments. To improve permeability of the subterranean environments, the fracturing process is applied to fracture formation levels of the subterranean environment. In an example, fluids may be pumped under higher pressure through the wellhead as part of the fracturing process. The fluids may include components, such as a liquid component and proppants. The proppants include one or more of sand, bauxite, and other particulate abrasives. The fluids are also referred to as abrasive slurries in the present disclosure.

The abrasive slurry, such as water and proppant mixed together, may be pumped through the subterranean formation through the fracturing tree. Gas fields or wellsites that are under development may require higher flow rates of the mixture that may be delivered through one or more injection lines. The flow of components from the one or more injection lines may be mixed together in a chamber of the fracturing wellhead. The fracturing wellhead guides the mixture with the abrasive slurries to a wellbore casing. As the diameter of the chamber of the fracturing wellhead is larger than the casing diameter, a reduction in diameter may be provided via a reducer or segment of the wellhead prior to guiding the abrasive slurries into the casing. As the abrasive slurries mix and flow at high flowrates, the reducer is subject to material erosion and its working life may be reduced. This increases operational costs as the reducer may be required to be replaced.

SUMMARY

An inverted diffuser for wellhead and wellsite equipment is disclosed. The system includes at least one first section having a first vertical inner surface, a first inclined inner surface relative to the first vertical inner surface, and one or more channels supporting one or more releasable fasteners between the at least one first section and a wall of a wellhead or of a wellsite equipment. The system also includes at least one second section having a second vertical inner surface and a second inclined inner surface relative to the second vertical inner surface. The at least one second section is press-fitted or fastened adjacent to the at least one first section in the system.

A method for application of an inverted diffuser that uses at least one releasable section in a wellhead is also disclosed. The method includes placing a first one of the at least two releasable sections into the wellhead or the wellsite equipment. The at least two releasable sections have a first vertical inner surface and a first inclined inner surface relative to the first vertical inner surface. The method also includes placing a second one of the at least two releasable sections into the wellhead or the wellsite equipment adjacent to the first one of the at least two releasable sections. The method further includes fastening the first one of the at least two releasable sections to a wall of the wellhead using one or more releasable fasteners within one or more channels of the first one of the at least two releasable sections so that the at least two releasable sections are held in place against the wall of the wellhead or the wellsite equipment.

A method for manufacturing an inverted diffuser for a wellhead is additionally disclosed. The method includes determining dimensions of a segment of the wellhead that is adapted to include the inverted diffuser. A further step in the method is machining, based at least in part on the dimensions, at least two releasable sections to include, on individual first sides of the at least two releasable sections, a vertical inner surface and a inclined inner surface relative to the vertical inner surface. The method includes drilling one or more channels into an individual second side of at least one of the at least two releasable sections and threading the one or more channels to receive one or more releasable fasteners.

BRIEF DESCRIPTION OF THE DRAWINGS

Various embodiments in accordance with the present disclosure will be described with reference to the drawings, in which.

DETAILED DESCRIPTION

Figure 1:
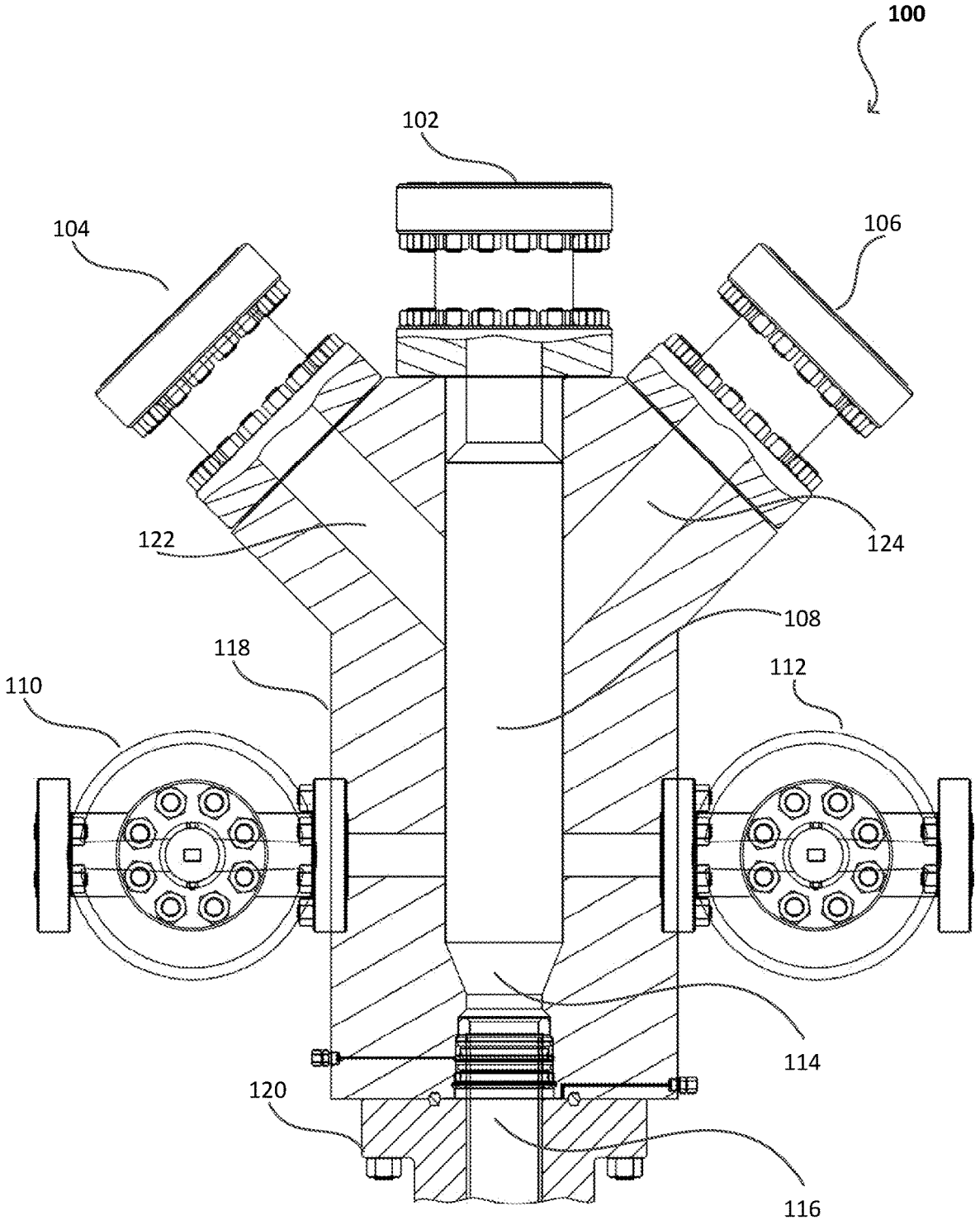
FIG. 1 illustrates an example wellhead subject to improvements of the present embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Various other functions can be implemented within the various embodiments as well as discussed and suggested elsewhere herein. In at least an aspect, the present disclosure is to an inverted diffuser having at least one releasable section to mix and guide abrasive slurries in a wellhead or other wellsite equipment.

Replaceable sleeves may include higher hardness material and may be used in parts of the fracturing wellhead. Such sleeves may be cylindrical in shape and may be installed through a bore of the fracturing head, such as from the top or from the bottom of the fracturing head. The replaceable sleeves may be inserted into the fracturing head through a continuous cavity and may be locked in place using a flange or auxiliary block in the wellhead. Furthermore, a polymeric coating may be applied to the replaceable sleeve, but its effect is limited to prevent degradation or damage when the abrasive slurries are flowing at very high flowrates (e.g., 220 barrels per minute (bpm) or 42 U.S. gallons per minute). As a matter of reference, present flow rate that may exist on lower to mid flowrate equipment is about 110 bpm. Still further, a replaceable sleeve that is directly inserted into the fracturing head can include the mix chamber in the sleeve, but such an implementation experiences erosion issues because of the location and makes replacement time consuming.

In at least one aspect, the present disclosure is for an inverted diffuser that has sections that can be inserted into the larger diameter of the fracturing head through a smaller bore and locked in place with fasteners, such as bolts, to a segment of the fracturing head. The sections may be determined based in part on the dimensions of the segment of a mixing chamber in the fracturing head. For instance, the number of sections as well as dimensions of the sections may be based in part on the internal dimensions of the segment. The sections, therefore, may be designed to have a cross-section dimension smaller or lesser than a through-bore diameter of segment of the fracturing wellhead where the inverted diffuser will be located. This dimensioning process allows inserting of the sections through the bore and allows installing of the sections on inner walls of the inverted diffuser segment of the mixing chamber.

In at least one aspect, the sections may be made entirely or partly (e.g., surface coated) with a tougher or harder material. In at least one instance, the sections may be carbide-coated. The tougher or harder material reduces erosion of the inverted diffuser as the abrasive slurries flow through the segment and are subject to reduction in cross-section to the subsequent bore. In the event of damage during operation, the sections may be replaced, thereby extending life of the fracturing head. The present inverted diffuser may be applied in wellheads and in other wellsite equipment that maybe other than subterranean, including surface or subsea equipment, that experience erosion due to abrasive slurries within limited areas to provide surface or material protection.

In at least one aspect, channels or holes are drilled into the segment and at least partly through the sections to allow the installation of the sections against inner walls of the segment and to allow releasable fastening of the sections to the inner walls using fasteners from the outside wall of the segment. In at least one aspect, bolts may serve as the fasteners to secure the sections in place or in location. The bolts may have a bolt head and are screwed through the channel of the segment to the channel of the sections (at its back side), but may not extend to a front side of the sections that includes the toughened or hardened material and that is exposed to the abrasive slurries. The channels of the segment also enable pressure sensors to be coupled thereon, with a gap maintained between the pressure sensors and the head of the bolts. This enables a sub-system to determine possible degradation of the sections. For instance, a change in the pressure in the gap may be a result of a leak from within the chamber. An operator may monitor the sub-system to determine damage or degradation of internal parts, such as the sections.

In at least one aspect, the sections or internal walls of the fracturing head may be damaged or eroded as a result of managing the abrasive slurries. When the damage or erosion is to a point where some leak is experienced through the channels forming the bolt holes of the segment, such as from behind the sections or between the sections and through the sections' channels to the segment's channels, the leak is detected or indicated by a pressure change (e.g., increased pressure) in the monitoring sub-system. The threshold of damage or degradation may be the leak and the pressure change may be asserted from prior leaks correlated to prior pressure changes or to new leaks causing new pressure changes. In at least one aspect, based in part on the pressure sensor inside the channels of the segment of the fracturing head, the sections may be replaced as necessary. This allows embedded technology that can withstand higher flow rates for certain applications using the same fracturing head. Certain applications may require higher flow rates for the abrasive slurries that could cause rapid erosion of the inverted diffuser.

In at least one aspect, computational fluid dynamics (CFD) simulations indicate an erosion rate of 0.030 inches per hour for the inverted diffuser of the present disclosure, when the abrasive slurries are flowing at about 220 bpm through the reducer of the fracturing head. On the straight bore, the erosion rate indicates 0.0015 inches per hour at the same flowrate level, which reflects that the bore area is subject to 20 times lower erosion features than in the reducer area. The tougher or harder material in the inverted diffuser sections of the present disclosure may extend the life of the reducer segment by allowing reuse of the same segment and the fracturing head by only replacing the sections of the inverted diffuser. The pressure monitoring sub-system may be calibrated and the calibrations may be used to train a learning system to indicate to an operator when the sections may need replacement. For instance, using a multi-node neural network trained to correlate leaks through the channel gaps of the segment holding the sections to pressure changes monitored off of pressure sensors, the monitoring sub-system may be adapted to determine the pressure or pressure changes that are outside a threshold or that do not satisfy a threshold. This indication of the pressure or the pressure changes being outside of or not satisfying the threshold may be indication of degradation, such as erosion or other failure of the sections; and this indication may be used to consider changing the sections, for instance.

Examples of a computer system or feature operable within the monitoring sub-system may include a computer-readable medium that may be enabled for communications with external devices for communicating at least pressure information or pressure changes. In addition, the computer system included at the well site or remotely, may include multi-processor capabilities to train and test neural networks to correlate the pressure and the degradation information gathered over at least a few cycles of operation of an inverted diffuser. Such a computer system may include one or more nonvolatile, hard-coded type media, such as read only memories (ROMs), or erasable, electrically programmable read only memories (EEPROMs); recordable type media, such as flash drives, memory sticks, and other newer types of memories; and transmission type media such as digital and analog communication links. For example, such media can include operating instructions, as well as instructions related to the systems and the method steps described previously and can operate on a computer. It will be understood by those skilled in the art that such media can be at other locations instead of, or in addition to, the locations described to store computer program products, e.g., including software thereon. It will be understood by those skilled in the art that the various software modules or electronic components described previously can be implemented and maintained by electronic hardware, software, or a combination of the two, and that such embodiments are contemplated by embodiments of the present disclosure.

FIG. 1 illustrates an example wellhead 100 subject to improvements in the present embodiments. Wellhead 100 includes a main bore 108 and side bores 122, 124 within a wellhead body 118. The wellhead 100 also includes multiple ports 102-106 to access the bores 108, 122, 124. The bores 108, 122, 124 are fluidly coupled together to enable mixing of the components provided through the ports 102-106. A flange 120 is provided to couple a through-bore 116 of smaller diameter than the main bore 108. Reducer 114 is provided either integral to the wellhead body 118 or as part of a segment associated with the wellhead body 118. In an example, an additional flange may be provided between the wellhead body 118 and the flange 120 to include the reducer 114. The reducer 114 enables an inverted diffuser to facilitate mixing of components forming the abrasive slurries.

The ports 102-106 enable connection to receive high-pressure lines for passing abrasives and other components, including fluids, from a high-pressure pump into the wellhead's main bore 108. The components, under high pressure endure vigorous agitation in the main bore 108 as the components enter from the side bores 122, 124 before being forced through the narrowing of the reducer providing additional diffusing of the components forming the abrasive slurry that then passes through the bore 116 of flange 120 for the fracturing process. Further, valves 110, 112 are provided for killswitch or choking functions.

Figure 2A:
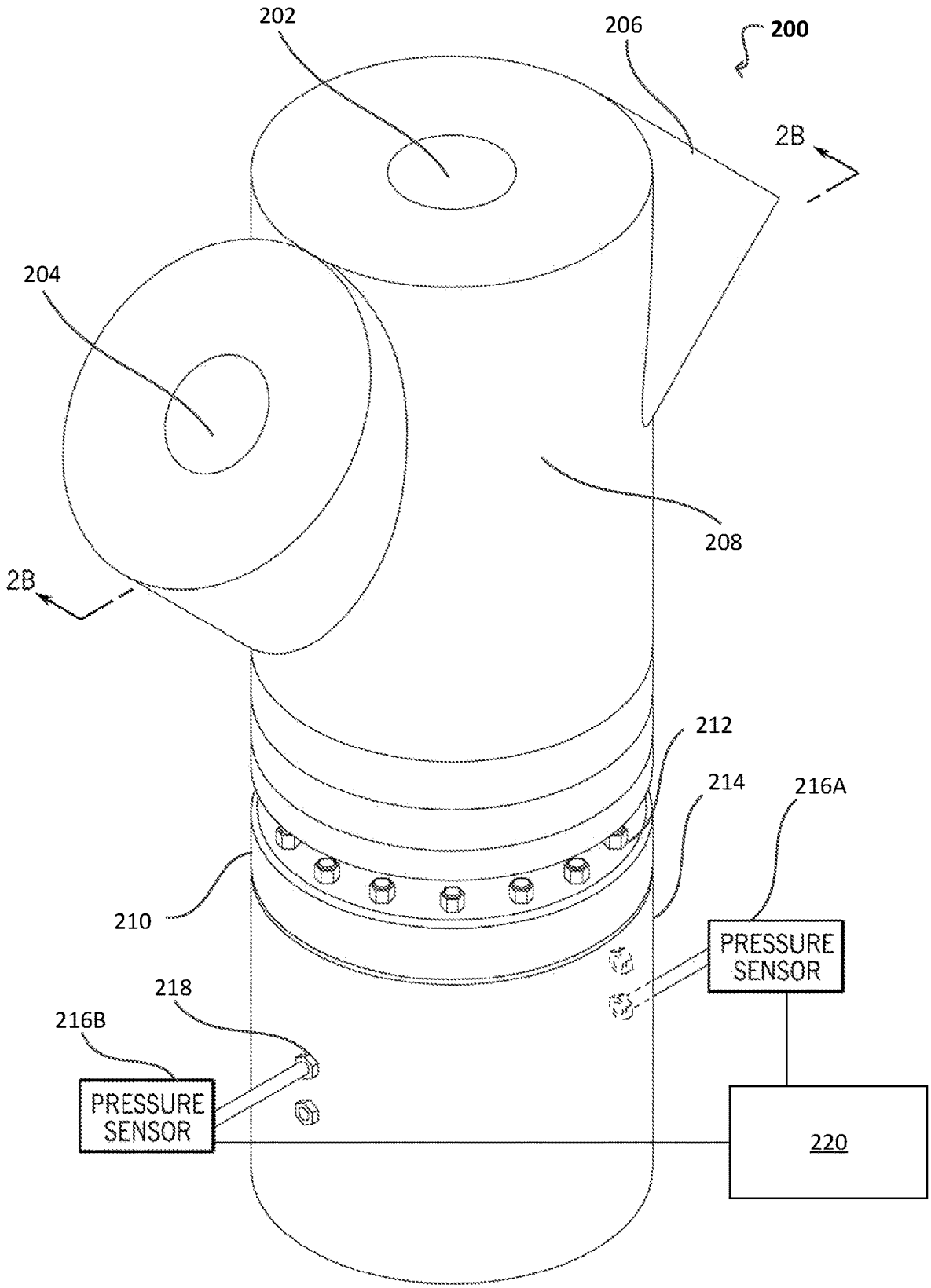
FIG. 2A is a perspective view of a wellhead incorporating an aspect of an inverted diffuser having at least two releasable sections to mix and guide abrasive slurries, in accordance with an embodiment in the present disclosure.

FIG. 2A is a perspective view of a wellhead 200 incorporating an aspect of an inverted diffuser having at least one releasable section to mix and guide abrasive slurries, in accordance with an embodiment in the present disclosure. Wellhead 200 includes a main port 202 providing access to a main bore and side ports 204, 206 providing access to side bores within a wellhead body 208. A person of ordinary skill would understand that the port and subsequent bores may be of wider inner diameter than illustrated and the bore walls are not proportionally illustrated in the present figures. The bores are fluidly coupled together to enable mixing of the components provided through the ports 202-206. A segment 214 is provided to couple the main bore to a reducer having the inverted diffuser, which is further illustrated in FIG. 2B, for instance. The reducer may be further coupled to a through-bore of smaller diameter than the main bore. The reducer is illustrated as part of the segment 214 that is separated from the wellhead body 208, but that is coupled to the wellhead body 208 using bolts 212 on at least a flange 210. In an example, an additional flange may be provided between the segment 214 and a further through-bore below the reducer.

FIG. 2A also illustrates that the segment 214 has one or more pressure sensors 216A, 216B associated with channels within the segment 214. The one or more pressure sensors 216A, 216B are releasably coupled to the one or more second channels with respective gaps maintained between the one or more pressure sensors 216A, 216B and a respective one or more of the individual heads of one or more bolts that hold the one or more sections in place within the segment 214. Furthermore, while two of the channels are illustrated without pressure sensors, a person of ordinary skill would recognize, upon reading the present disclosure, that further pressure sensors, as many as required for an application, may be applied in the available one or more channels.

The ports 202-206 enable connection to receive high-pressure lines for passing abrasives and other components, including fluids, from a high-pressure pump into the wellhead's main bore. The components, under high pressure endure vigorous agitation in the main bore as the components enter from the side bores before being forced through the narrowing of the reducer providing additional diffusing of the components forming the abrasive slurry that then passes through a connected bore below the reducer for the fracturing process.

Further, in at least one aspect, the pressure sensors are able to monitor for any abnormal internal erosion in the fractural head, before any catastrophic failure. For instance, signals or values communicated from one or more pressure sensors 216A, 216B are processed in at least one processor of monitoring module or sub-system 220. The at least one processor, in an example, may be adapted to execute instructions for a multi-node neural network trained to correlate leaks through the channel associated with the bolts of the segment to pressure changes monitored off of the pressure sensors. The monitoring module or sub-system 220 may be adapted to determine the pressure or pressure changes that are outside a threshold or that do not satisfy a threshold. This indication of the pressure or the pressure changes being outside of or not satisfying the threshold may be indication of degradation, such as erosion or other failure of the sections; and this indication may be used to consider changing the sections, for instance.

Once erosion is detected to a point that the indication is made, an operator may replace the sections of the inverted diffuser with a new set of sections, but the fracturing head or the segment upon which the sections are mounted can continue to remain in operation with the new set of sections. Such a solution enables the wellsite equipment to have a longer life by planning for requirement maintenance based in part on the intelligent monitoring of the pressure sensors to reduce the risk of catastrophic failure. Moreover, the longer the endurance for wellsite equipment, the lesser the downtime periods for operations on the wellsite. This also enables reduced logistics for shipping of heavy equipment required to conduct the maintenance if a new fracturing wellhead is required. Cost savings achievable from the present aspects is also associated with a reduced number of fracturing wellheads that may be required to complete a fracturing process or operation at a wellsite; and particularly when high flowrates (e.g., 220 bpm) of the abrasive slurries are required.

Figure 2B:
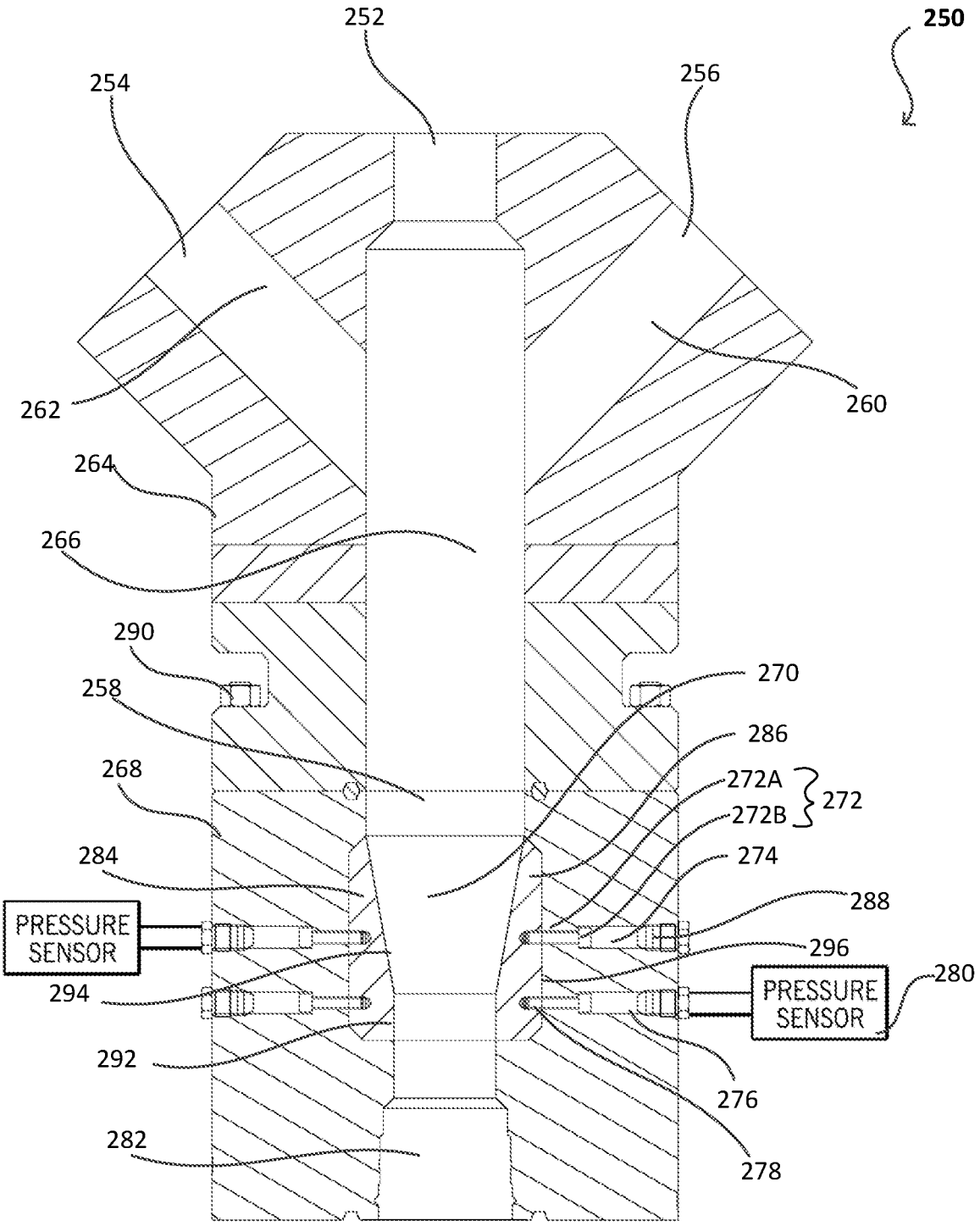
FIG. 2B is a cross-section view of a wellhead incorporating the inverted diffuser, such as from FIG. 2A, in accordance with an aspect of the disclosure.

FIG. 2B is a cross-section view of a wellhead 250 incorporating the inverted diffuser, such as from FIG. 2A, in accordance with an aspect of the disclosure. The inverted diffuser is formed of an arrangement of sections that include a vertical surface 292 below an inclined surface 294. At least two of the sections are illustrated in the cross-section as reference numerals 284, 286. Further, the segment 268 coupled to the wellhead body 264 via bolts 290 (one bolt is illustrated) and may be referred to as a reducer section for including the reducer 270 formed of the inverted diffuser sections. A first section 284 and at least one second section 286 of the inverted diffuser are provided so that at least one of the two sections may be fastened to a wall of the wellhead or wellsite equipment. There may be other configurations of the at least two sections. In an aspect, the at least one first section has one or more channels 278 to receive a fastener, such as a bolt that holds the at least one first section to a wall of the segment 268. The at least one second section may similarly include one or more channels to receive a fastener, such as a bolt that holds the at least one second section to a wall, or the at least one second section may, differently from the at least one second section, not include the one or more channels and may be held in place by a press-fit against the wall of the segment 268 and the at least one first section that is fastened to the wall. Press-fit refers to positioning a section against one or more sections and the wall so that at least surface friction from the one or more sections and the wall hold the section in place. As such, at least one against section of the one or more sections may be fastened using or more bolts as in the aspects throughout this disclosure. The act of press-fitting refers to achieving the press-fit for the section requiring press-fit with another section, for instance.

In at least one aspect, the arrangement of sections may include two second sections forming the at least one second section, and with the two second sections being press-fitted with the at least one first section that is fastened to the wall of the segment. Alternatively, the arrangement of sections may include two first sections forming the at least one first section that are fastened to the wall of the segment, and two second sections forming the at least one second section which are both press-fitted with the two first sections. In a further alternative, the arrangement of sections may include the at least one second section that is adapted to be fastened to the wall along with, and located adjacent to, the at least one first section. In yet another alternative arrangement of the section, two or three second sections with adaptations to be fastened may be provided to form the at least one second section and to be fastened to the wall along with, and adjacent to, the at least one first section.

FIG. 2B also illustrates that at least one of the sections (e.g., at least one first section 286) may include a vertical inner surface 292, a inclined inner surface 294 relative to the vertical inner surface 292, and one or more first channels 278 supporting one or more releasable fasteners 272 between the at least one first section 286 and a wall 296 of a wellhead or of a wellsite equipment 250. For illustrative purposes only one first channel of the four illustrated channels—as readily apparent from the figure—is marked by the reference numeral. Further, at least one of the sections (e.g., at least one second section 284) may include a second vertical inner surface and a second inclined inner surface relative to the second vertical inner surface, so that the at least one second section may be press-fitted or fastened adjacent to the at least one first section. As FIG. 2B illustrates similar symmetrical arrangement of at least two sections 284, 286, a person of ordinary skill reading the present disclosure can infer description for the at least one section 284, as to a second vertical inner surface and a second inclined inner surface included therein, from the description provided with respect to the at least one first section 286 (and the descriptions made with reference to the other figures herein). A person or ordinary skill would also recognize that the cross-section shows limited views of the arrangement of the sections and further sections than the sections 284, 286 already described may be included circumferentially within the reducer 270. Example arrangements of the sections are provided in at least FIGS. 5A, 5B, and 6.

Further, when the at least one second section 286 is not provided with ability to receive fasteners, one or more side surfaces (e.g., sides 562A, 562B on section 554B in FIG. 5B) on the at least one second section 286 enable press-fitting of the at least one second section 286 with the at least one first section 284 which is fastened within the wellhead or the wellsite equipment 250. Still further, the segment 268 has one or more second channels 276 (one channel of the four illustrated channels—as readily apparent from the figure—is marked by the reference numeral) for supporting the one or more releasable fasteners 272 (one of the four fasteners is marked for illustrative purpose) from an outer surface 288 of the segment 268 to the at least one first section 286.

FIG. 2B also illustrates that the fasteners 272 may be one or more bolts. Each bolt includes a bolt head 272B and a bolt body 272A for threading in a respective first channel (e.g., first channel 278). As the bolts are removable, they form the one or more releasable fasteners. Further, as the bolts are adapted to thread within the one or more first channels, the depth the bolts reach enables individual heads of the one or more bolts to be partly within the one or more second channels (e.g., second channel 276). The one or more pressure sensors (e.g., pressure sensor 280, 288) are releasably coupled to the one or more second channels with respective gaps (e.g., gap 274) maintained between the one or more pressure sensors and a respective one or more of the individual heads.

FIG. 2B also illustrates that wellhead 250 includes a main port 252 providing access to a main bore 266 and side ports 254, 256 providing access to side bores 260, 262 within a wellhead body 258. The bores 260, 262, 266 are fluidly coupled together to enable mixing of the components provided through the ports 252-256. The segment 268 is provided to couple the main bore 266 to a reducer 270 (having reducer opening 258) having the inverted diffuser sections. The reducer 270 may be further coupled to a through-bore 282 of smaller diameter than the main bore 266. The reducer is illustrated as part of the segment 268 that is separated from the wellhead body 264, but that is coupled to the wellhead body 264 using bolts 290 (one bolt is illustrated) on at least a flange. In an example, an additional flange may be provided between the segment 214 and the further through-bore 282 below the reducer. FIG. 2B illustrates that the sections 284, 286 are sufficiently dimensioned to be able to pass through the reducer opening 258 or through the main port 252 and bore 266 to the location in the reducer 270, prior to being fastened or press-fitted in position.

Figure 3:
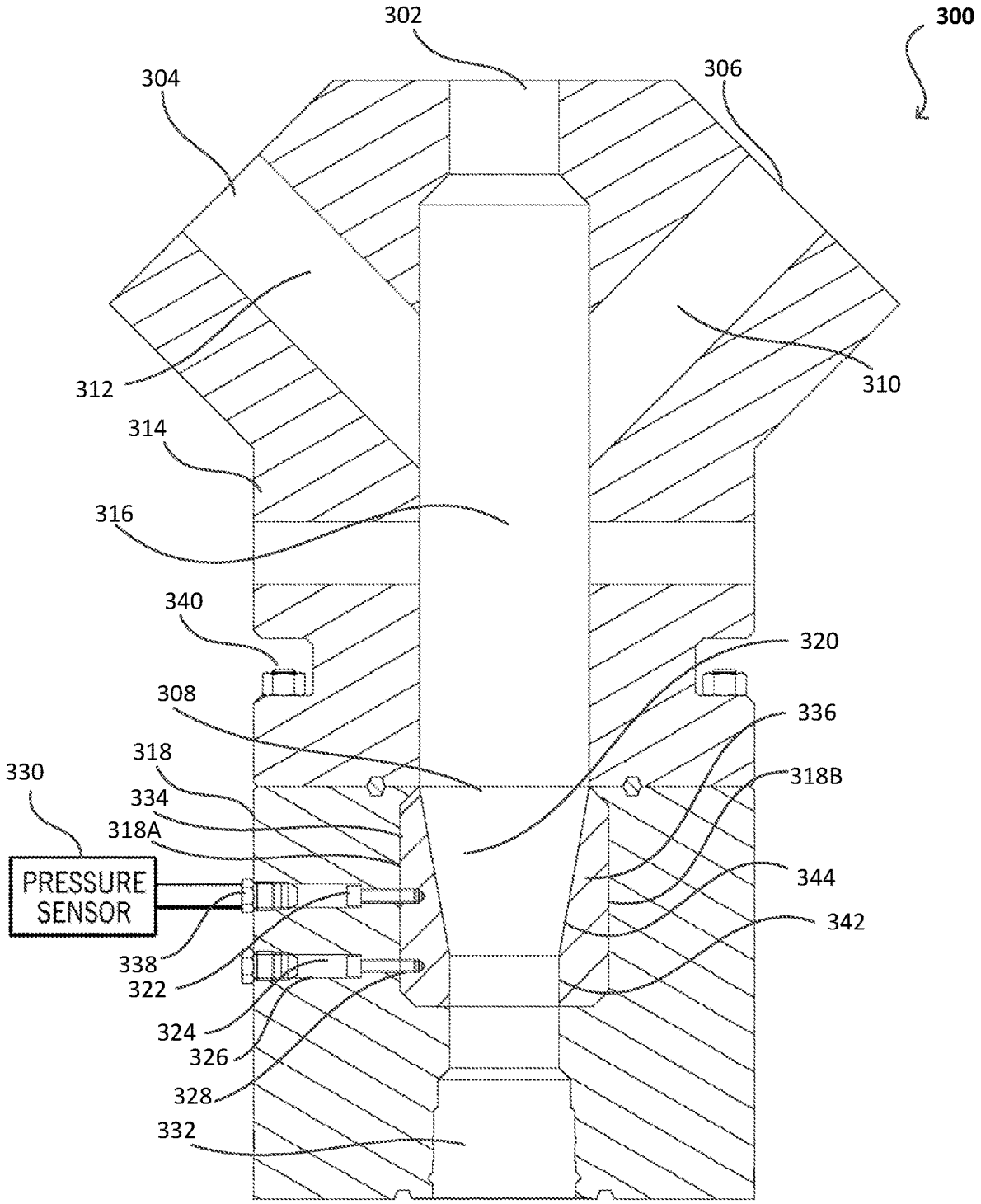
FIG. 3 is a cross-section view of a wellhead incorporating a further aspect of an inverted diffuser having at least two releasable sections, in accordance with an embodiment in the present disclosure.

FIG. 3 is a cross-section view of a wellhead 300 incorporating a further aspect of an inverted diffuser having at least one releasable section, in accordance with an embodiment in the present disclosure. The embodiment of FIG. 3 illustrates an inverted diffuser that is formed of an arrangement of sections, illustrated in the cross-section as reference numerals 334, 336, and that are positioned closer to an opening 308 of the segment 318. Further, the segment 318 is attached to the wellhead body 314 via at least bolts 340 (one bolt is illustrated). A first section 334 and at least one second section 336 of the inverted diffuser are provided so that at least one of the two sections (e.g., at least the first section 334) may be fastened to a wall of the wellhead or wellsite equipment. As previously described in reference to the embodiment in FIG. 2B, the configuration of the at least two sections in FIG. 3 is so that the at least one second section 336 is press-fit with the at least one first section 334.

In at least one aspect, the at least one first section 334 has one or more channels (one is illustrated with reference numeral 328) to receive a fastener, such as a bolt that holds the at least one first section 334 to a wall 318A of the segment 318. The at least one second section 336, differently from the at least one second section, does not include the one or more channels and may be held in place by a press-fit against the wall 318B of the segment 318 and the at least one first section 334 that is fastened to the wall. As the illustration in FIG. 3 is a cross-section, one or ordinary skill would recognize that the wall is an inner circumference of the segment 318, and that reference numerals 318A, 318B refer to the same wall, but at different locations. Further, in at least one aspect, the segment 318 opens directly to the reducer section 320, via opening 308, without a need for a vertical section illustrated in the opening of the reducer 270 of FIG. 2B. As such, FIGS. 2B and 3 illustrate that the sections may be adapted to fix at different determined locations within the segment intended to include a reducer in a wellhead or other wellsite equipment.

FIG. 3 also illustrates that at least one of the sections (e.g., at least one second section 336) may include a vertical inner surface 342 and a inclined inner surface 344 relative to the vertical inner surface 342. In the embodiment of FIG. 3, the at least one first section 334 includes the one or more first channels 328 supporting one or more releasable fasteners 322 between the at least one first section 334 and the wall 318A of the wellhead or of the wellsite equipment 300. For illustrative purposes only one first channel of the two illustrated channels—as readily apparent from the figure—is marked by the reference numeral. Further, the at least one second section 336 is not illustrated to include fasteners in the cross-section, but the fasteners may be located elsewhere in an outer circumference of the section 336 or the section 336 may be designated for being press-fitted adjacent to the at least one first section 334. As FIG. 3 illustrates similar symmetrical arrangement of at least two sections 334, 336, a person of ordinary skill reading the present disclosure can infer description for the at least one first section 334, as to a second vertical inner surface and a second inclined inner surface included therein, from the description provided with respect to the at least one second section 226 (and the descriptions made with reference to the other figures herein).

FIG. 3 also illustrates that the fasteners 322 may be one or more bolts. Each bolt includes a bolt head and a bolt body for threading in a respective first channel (e.g., first channel 328). As the bolts are removable, they form the one or more releasable fasteners. Further, as the bolts are adapted to thread within the one or more first channels, the depth the bolts reach enables individual heads of the one or more bolts to be partly within the one or more second channels (e.g., second channel 326). The one or more pressure sensors (e.g., pressure sensor 330, 338) are releasably coupled to the one or more second channels with respective gaps (e.g., gap 324) maintained between the one or more pressure sensors and a respective one or more of the individual heads.

FIG. 3 also illustrates that wellhead 300 includes a main port 302 providing access to a main bore 316 and side ports 304, 306 providing access to side bores 310, 312 within a wellhead body 314. The bores 304, 306, 316 are fluidly coupled together to enable mixing of the components provided through the ports 302-306. The segment 318 is provided to couple the main bore 316 to a reducer 320 (having reducer opening 308) having the inverted diffuser sections. The reducer 320 may be further coupled to a through-bore 332 of smaller diameter than the main bore 316. The reducer 320 is illustrated as part of the segment 318 that is separated from the wellhead body 314, but that is coupled to the wellhead body 314 using bolts 340 (one bolt is illustrated) on at least a flange. In an example, an additional flange may be provided between the segment 318 and the further through-bore 332 below the reducer. FIG. 3 also illustrates that the sections 334, 336 are sufficiently dimensioned to be able to pass through the reducer opening 308 or through the main port 302 and bore 316 to the location in the reducer 320, prior to being fastened or press-fitted in position.

Figure 4:
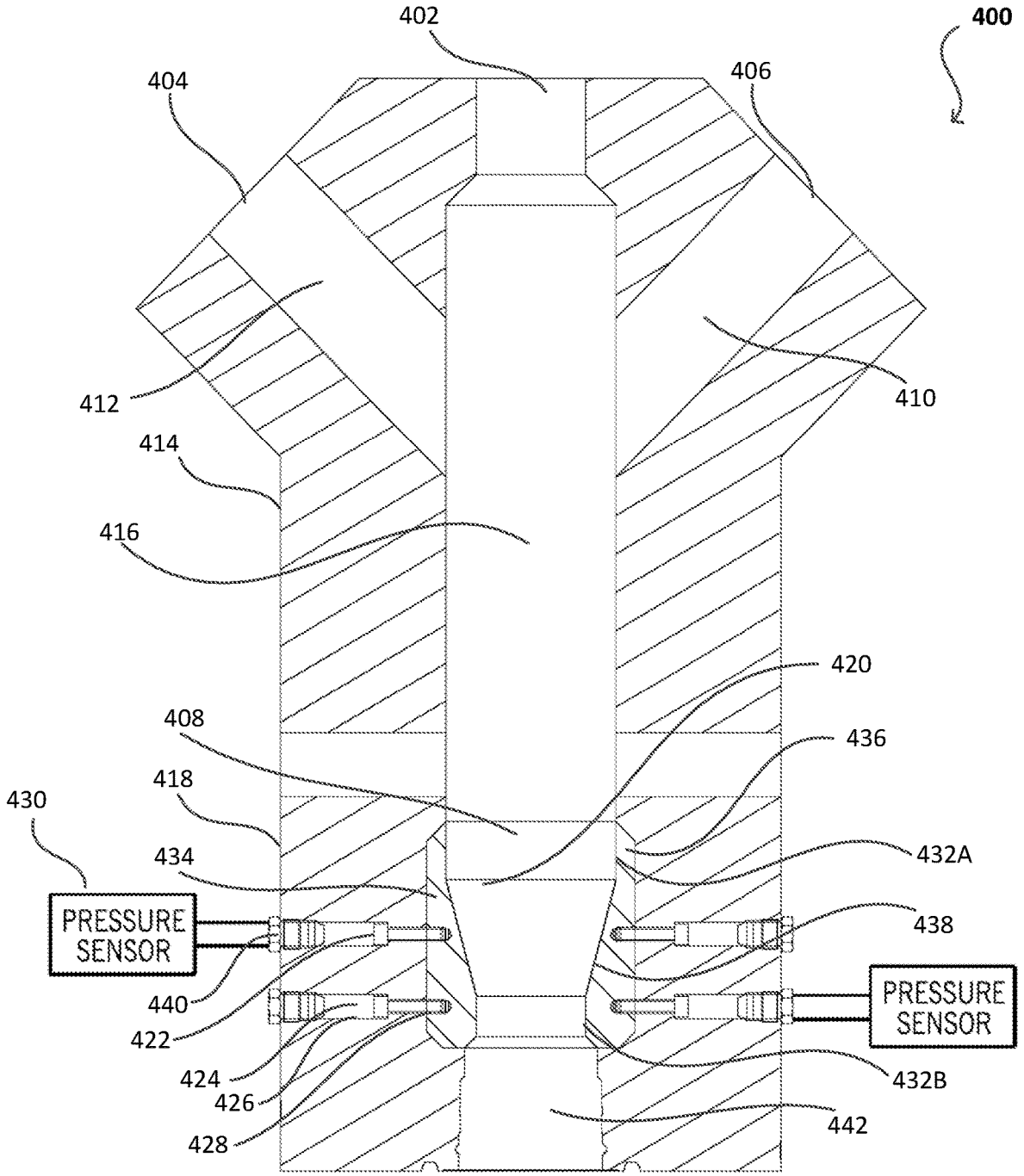
FIG. 4 is a cross-section view of a wellhead incorporating yet another aspect of an inverted diffuser having at least two releasable sections, in accordance with an embodiment in the present disclosure.

FIG. 4 is a cross-section view of a wellhead 400 incorporating yet another aspect of an inverted diffuser having at least one releasable section, in accordance with an embodiment in the present disclosure. The embodiment of FIG. 4 illustrates an inverted diffuser that is formed of an arrangement of sections and that includes multiple vertical surfaces 432A, 432B, and at least one prominent inclined surface 438. Additional inclined surfaces may exist, such as an inclined surface to enabling coupling the diameter of the segment 418 with through-bore 442, but the inclined surface 438 in the center of reducer 420 enables agitation and mixing in the inverted diffuser. Two of the sections are illustrated in the cross-section as reference numerals 434, 436. Further, the segment 418 is integral in the wellhead body 414. A first section 434 and at least one second section 436 of the inverted diffuser are provided so that at least one of the two sections (e.g., either of the at least one first section 434 and/or the at least one second section 436) may be fastened to a wall of the wellhead or wellsite equipment. As previously described in reference to the embodiment in FIG. 2B, the configuration of the at least two sections in FIG. 4 is so that no press-fit is required and all sections may be fastened to the wall of the wellhead body 414 at segment 418.

In at least one aspect, the at least one first section 434 has one or more channels (one is illustrated with reference numeral 428) to receive a fastener, such as a bolt that holds the at least one first section 434 to a wall of the segment 418. The at least one second section 436 also includes the one or more channels to fasten the at least one second section 436 to the wall. As the illustration in FIG. 4 is a cross-section, one or ordinary skill would recognize that the wall is an inner circumference of the segment 418, and that reference to the wall for both sections refer to the same wall, but at different locations. Further, in at least one aspect, the segment 418 opens to the reducer section 420, via opening 408, with a vertical section illustrated in the bore 416 prior to reaching the vertical surface 432A of the inverted diffuser sections. Therefore, in a similar manner as in FIGS. 2B and 3, FIG. 4 also illustrates that the sections may be adapted to fix at different determined locations within the segment intended to include a reducer in a wellhead or other wellsite equipment.

FIG. 4 also illustrates that the fasteners 422 may be one or more bolts. Each bolt includes a bolt head and a bolt body for threading in a respective first channel (e.g., first channel 428). As the bolts are removable, they form the one or more releasable fasteners. Further, as the bolts are adapted to thread within the one or more first channels, the depth the bolts reach enables individual heads of the one or more bolts to be partly within the one or more second channels (e.g., second channel 426). The one or more pressure sensors (e.g., pressure sensor 430, 440) are releasably coupled to the one or more second channels with respective gaps (e.g., gap 424) maintained between the one or more pressure sensors and a respective one or more of the individual heads.

FIG. 4 also illustrates that wellhead 400 includes a main port 402 providing access to a main bore 416 and side ports 404, 406 providing access to side bores 410, 412 within a wellhead body 414. The bores 404, 406, 416 are fluidly coupled together to enable mixing of the components provided through the ports 402-406. The segment 418 is provided to couple the main bore 416 to a reducer 420 (having reducer opening 408) having the inverted diffuser sections. The reducer 420 may be further coupled to a through-bore 432 of smaller diameter than the main bore 416. The reducer 420 is illustrated as part of the segment 418 that is separated from the wellhead body 414, but that is integral to the wellhead body 414. In an example, an additional flange may be provided between the segment 418 and the further through-bore 442 below the reducer. FIG. 4 also illustrates that the sections 434, 436 are sufficiently dimensioned to be able to pass through the reducer opening 408 or through the main port 402 and bore 416 to the location in the reducer 420, prior to being fastened or press-fitted in position.

Figure 5A:
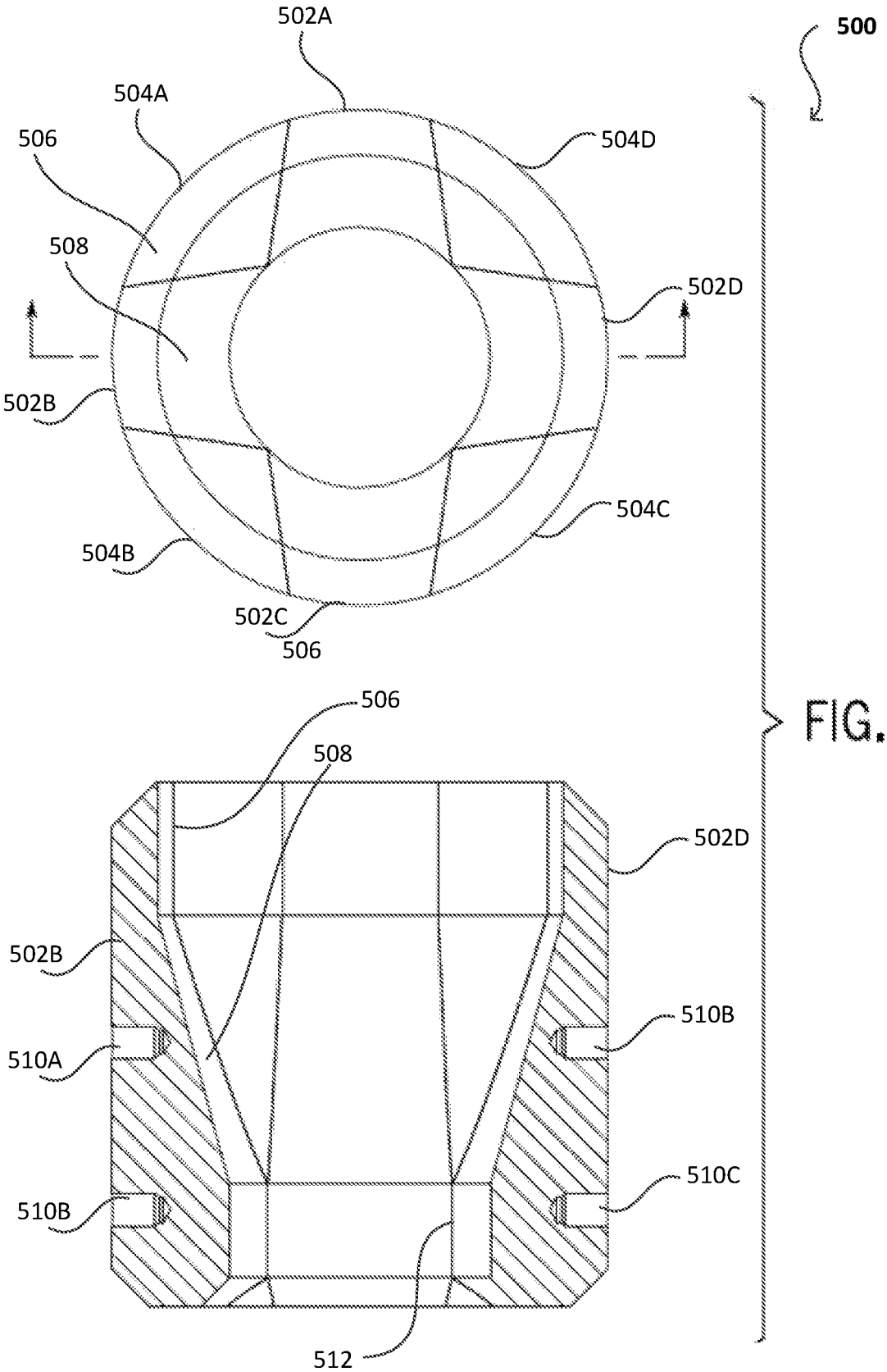
FIG. 5A illustrates different views of an inverted diffuser having at least two releasable sections, in accordance with an aspect in the present disclosure.

FIG. 5A illustrates different views of an inverted diffuser 500 having at least one releasable section 502A-D, 504A-D, in accordance with an aspect in the present disclosure. FIG. 5A illustrates a plan view and a cross-sectional view of an inverted diffuser that may be installed within the configuration of the wellhead 400 in FIG. 4. For instance, the inverted diffuser 500 has two vertical surfaces 506, 512, and one main or prominent inclined surface 508 that is inclined in reference to one or more of the vertical surfaces 506, 512. Furthermore, the first channels referred to in the embodiments of FIGS. 2B, 3, and 4 are also illustrated in FIG. 5A via reference numerals 510A-D. The first channels 510A-D are illustrated as having threads to receive respective bolts that will then hold the respective channels in place against the wall of the wellhead. FIG. 5A also illustrates that there are four fastening sections 502A-D (e.g., representing at least one first section in the embodiments of FIGS. 2A, 3, and 4) and four press-fitted sections 504A-D (e.g., representing at least one second section in the embodiments of FIGS. 2A and 3). The dimensions for the sections are all so that a plan-view dimension enables fitting of the sections through a bore and through an opening of the segment holding the reducer. Further, the dimensions for the sections are so that they can be fitted together, either press-fitted or fastened without (or with insignificant) gaps there between. In an aspect, the gap between sections may be about 0.025 to 0.035 inches, which may be a byproduct of a cutting process (e.g., saw, or laser), when the sections are machined from a singular material. The cross-section dimensions provide at least a height of the inverted diffuser and a thickness of each of the sections.

Figure 5B:
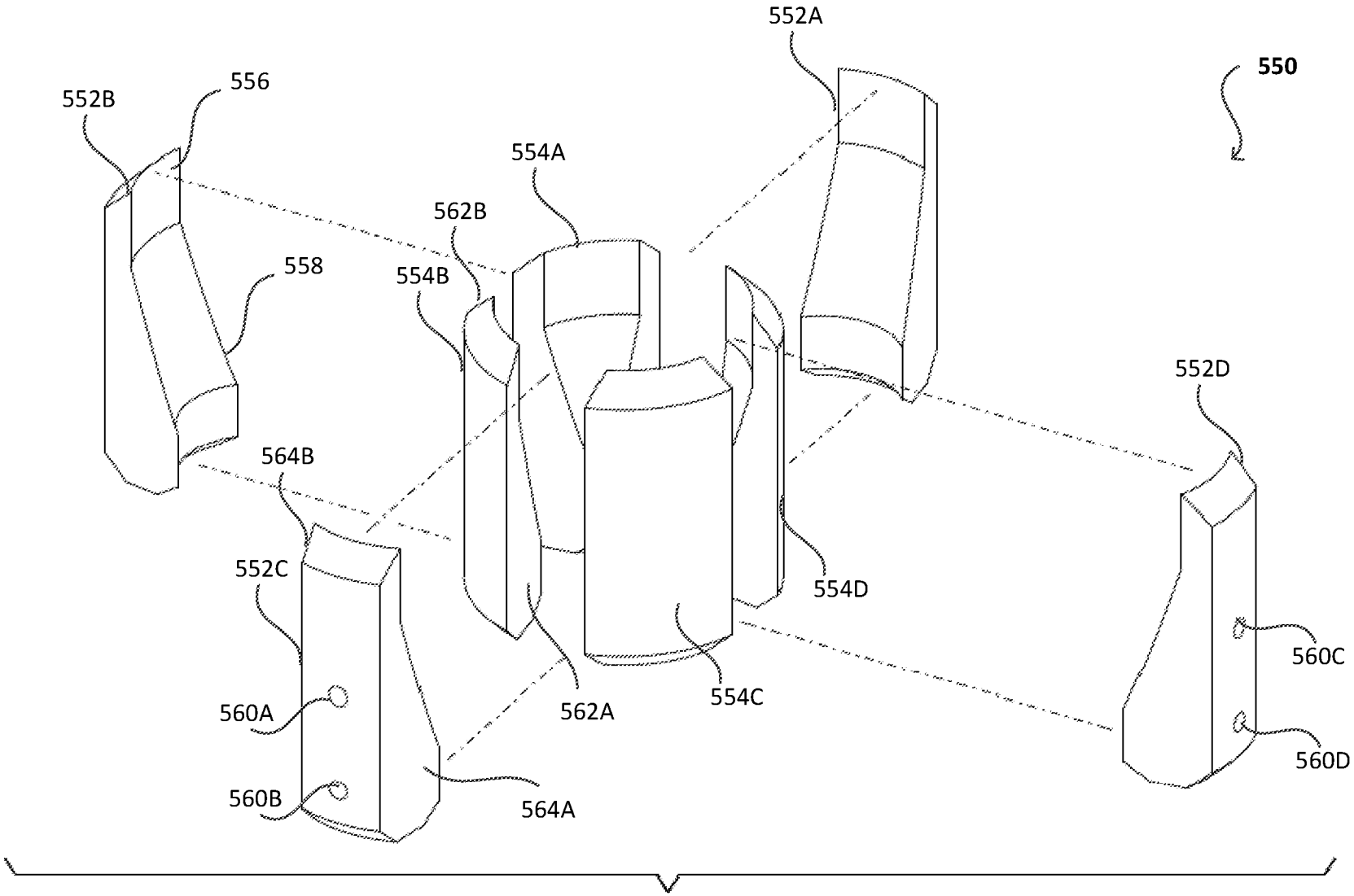
FIG. 5B illustrates a perspective view of sections forming an inverted diffuser, such as the inverted diffuser of FIG. 5A, in accordance with an aspect in the present disclosure.

FIG. 5B illustrates a perspective view of sections 552A-D, 554A-D forming an inverted diffuser 550, such as the inverted diffuser 500 of FIG. 5A, in accordance with an aspect in the present disclosure. However, different than the inverted diffuser 500 of FIG. 5A, the inverted diffuser 550 of FIG. 5B may be differently dimensioned or shaped so that the press-fit sections 554A-D have a wide internal dimension distinct from the wedge-shaped internal feature illustrated in sections 504A-D of FIG. 5A. Nonetheless, the dimensions and shapes of the sections may be predetermined to provide a best combination of one or more of a combination of press-fit and fastened sections for the application. In the case of high pressure and high abrasive slurries, it might be the case that fastened sections are better suited, but for lower abrasive slurries, press-fit sections may be used adjacent to at least one fastened section. Furthermore, the first channels referred to in the embodiments of FIGS. 2B, 3, and 4 are also illustrated in FIG. 5B via reference numerals 560A-D. The first channels 560A-D have threads, but may also include other releasable locking features, to receive respective bolts that will then hold the respective channels in place against the wall of the wellhead. Further, the press-fit sections 554A-D are illustrated as having side surface 562A, 562B to engage with side surfaces (e.g., side surface 564A or 564B) of the fastened sections 552A-D.

Figure 6:
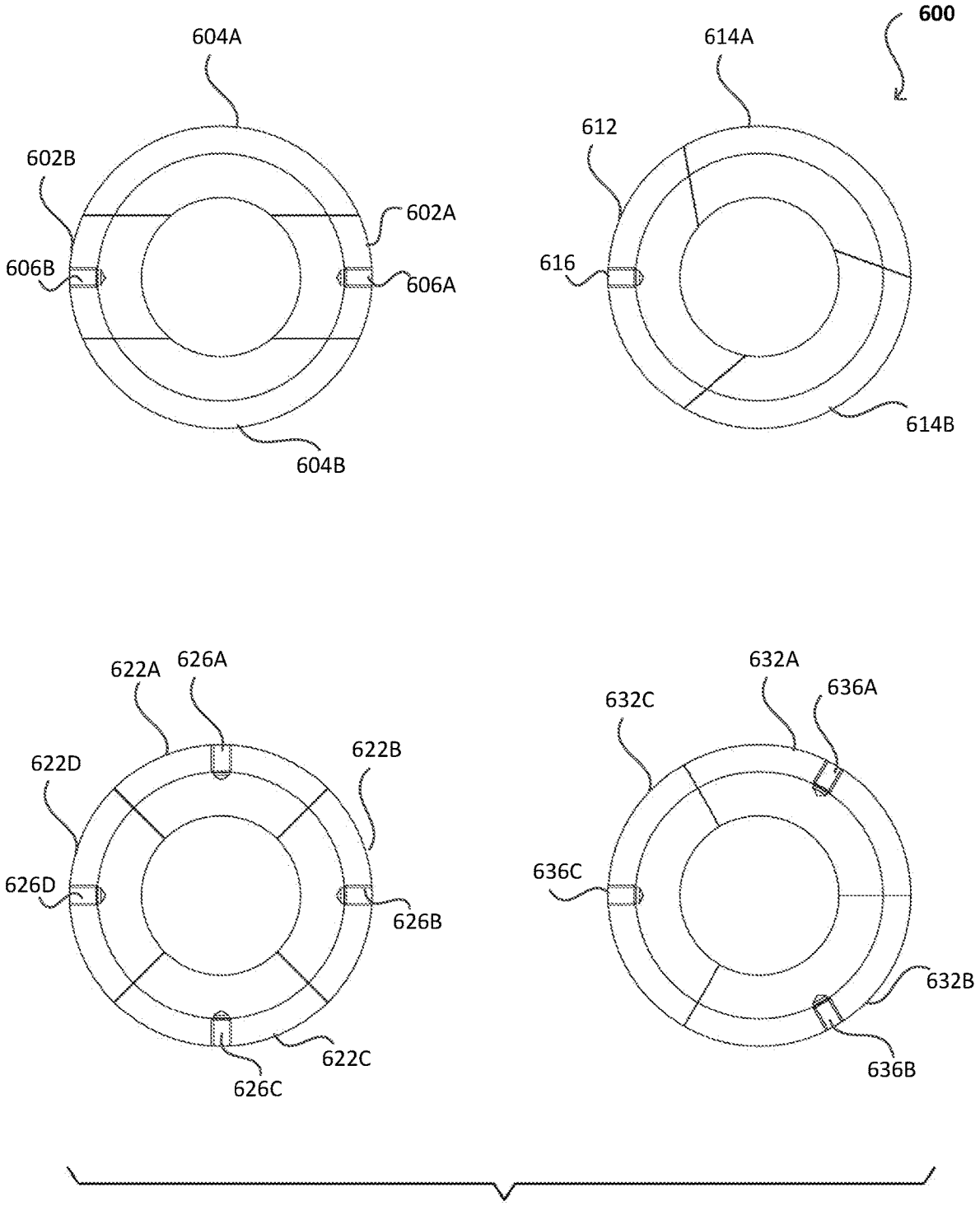
FIG. 6 illustrates plan views of different arrangements of sections for inverted diffusers having at least two releasable sections, in accordance with aspects in the present disclosure.

FIG. 6 illustrates plan views of different arrangements of sections 600 for inverted diffusers having at least two releasable sections, in accordance with aspects in the present disclosure. In at least one aspect, the arrangement of sections may include two first sections 602A, 602B forming the at least one first section that are fastened to the wall of a segment of a wellhead via fasteners in channels 606A, 606B; and two second sections 604A, 604B forming the at least one second section which are both press-fitted with the two first sections 602A, 602B. Alternatively, the arrangement of sections 600 may include two second sections 614A, 614B forming the at least one second section, and with the two second sections 614A, 614B being press-fitted with the at least one first section 612 that is fastened to the wall of the segment via a fastener at channel 616. In a further alternative, the arrangement of sections 600 may include the at least one second section 604A; 604B; 614A; 614B that is adapted to be fastened to the wall along with, and located adjacent to, the at least one first section 602A; 602B; 612. In yet another alternative arrangement of the section, two or three second sections 622A-C; 632A, 632B with adaptations to be fastened via channels 626A-C; 636A, 636B may be provided to form the at least one second section and to be fastened to the wall along with, and adjacent to, the at least one first section 622D; 632C that also has adaptations to be fastened via channels 626D; 636C. The channels are described and illustrated in the singular, but may be one or more channels in each section as illustrated in the cross-sectional and perspective views discussed throughout this disclosure.

Figure 7:
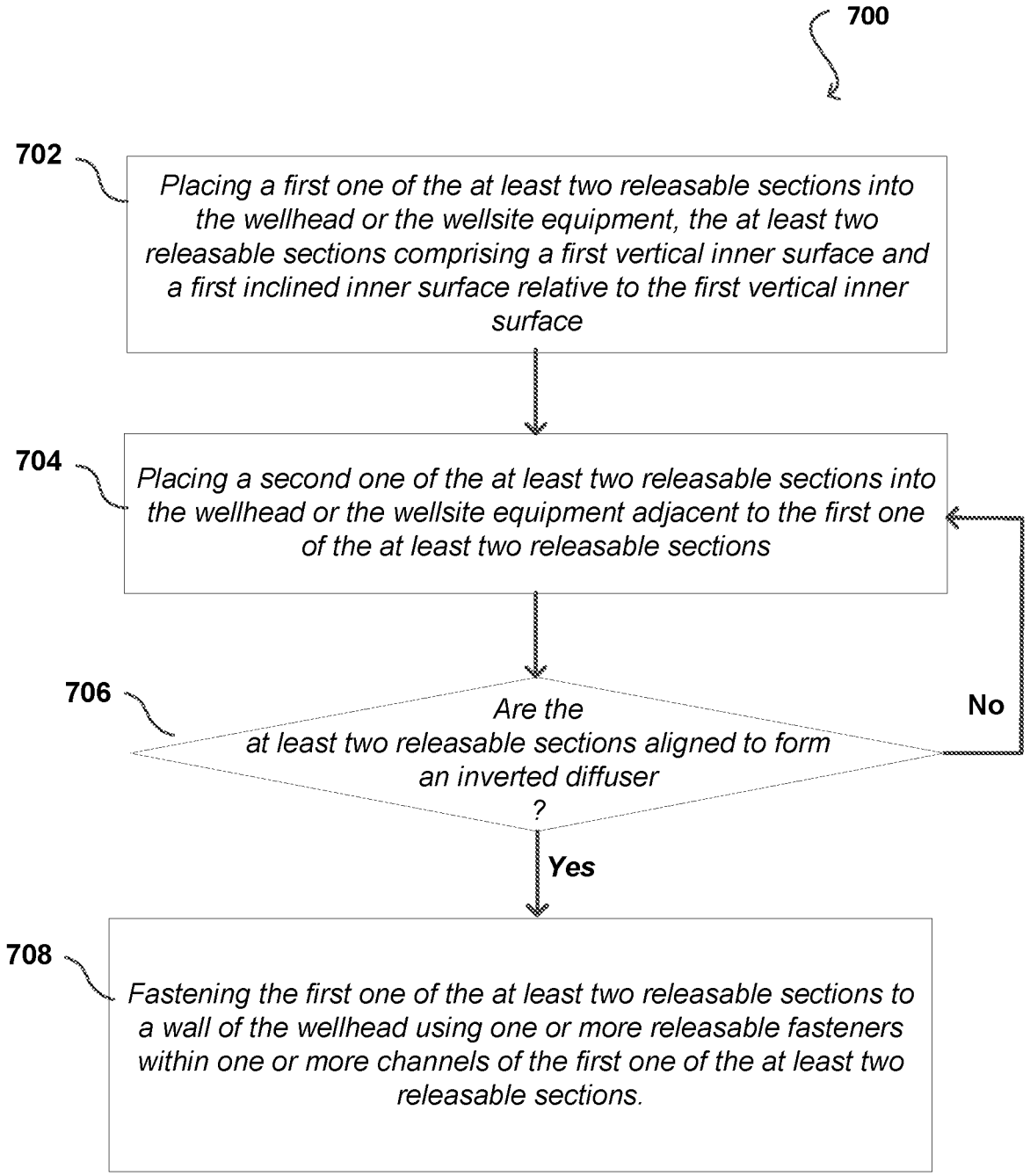
FIG. 7 illustrates a process flow of a method for application of an inverted diffuser that uses at least two releasable sections in a wellhead or other wellsite equipment, in accordance with an embodiment in the present disclosure.

FIG. 7 illustrates a process flow 700 of a method for application of an inverted diffuser that uses at least two releasable sections in a wellhead or other wellsite equipment, in accordance with an embodiment in the present disclosure. The method includes placing 702 a first one of the at least two releasable sections into the wellhead or the wellsite equipment. The at least two releasable sections have a first vertical inner surface and a first inclined inner surface relative to the first vertical inner surface. The method also includes placing 704 a second one of the at least two releasable sections into the wellhead or the wellsite equipment adjacent to the first one of the at least two releasable sections. Alignment of the first and the second ones of the at least two releasable sections may be verified in sub-process 706. Placement may be repeated via at least sub-process 704 if required. The method further includes fastening 708 the first one of the at least two releasable sections to a wall of the wellhead using one or more releasable fasteners within one or more channels of the first one of the at least two releasable sections so that the at least two releasable sections are held in place against the wall of the wellhead or the wellsite equipment.

Figure 8:
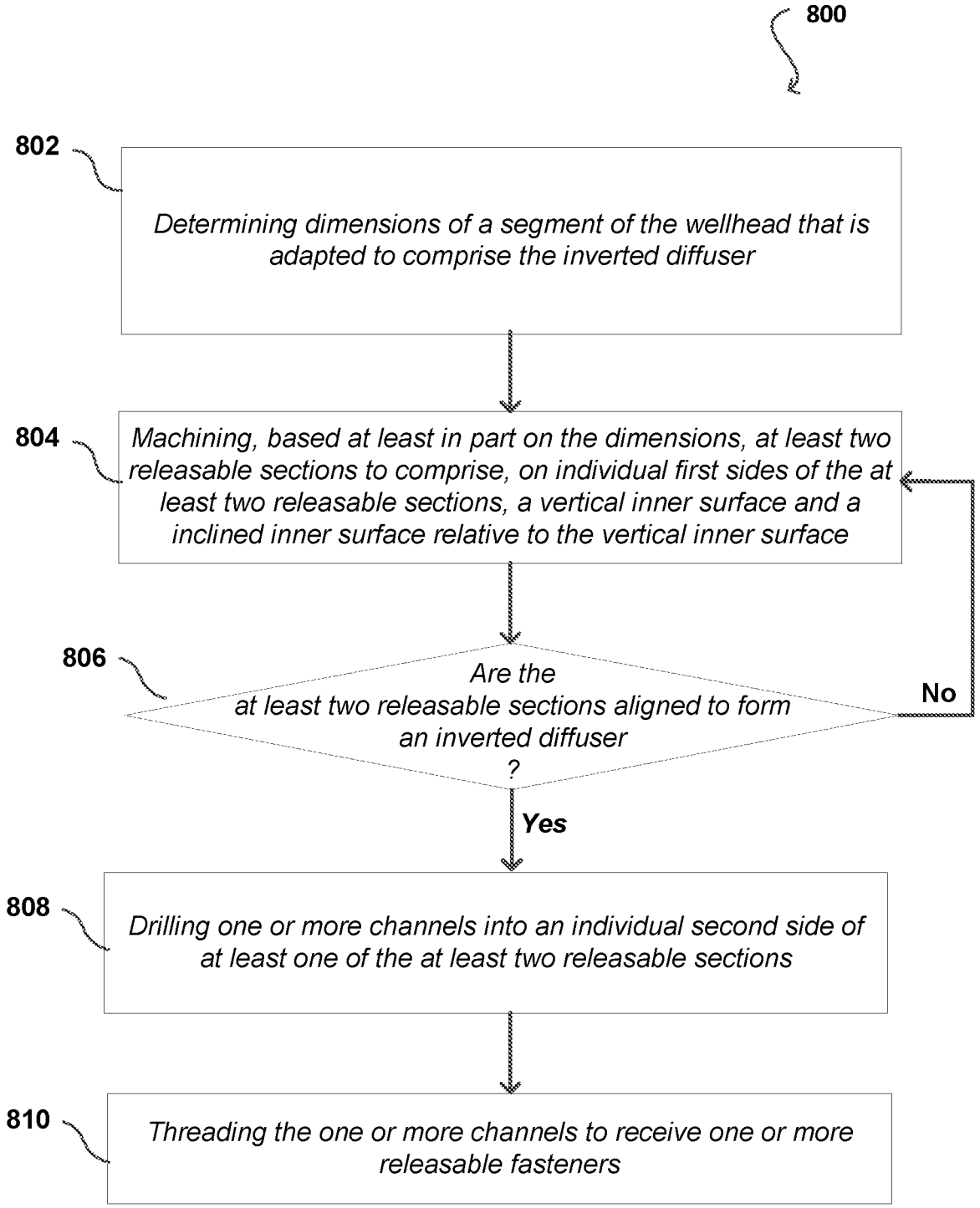
FIG. 8 illustrates a process flow of a method for manufacturing an inverted diffuser having at least two releasable sections for use within a wellhead or other wellsite equipment, in accordance with an embodiment in the present disclosure.

FIG. 8 illustrates a process flow 800 of a method for manufacturing an inverted diffuser having at least two releasable sections for use within a wellhead or other wellsite equipment, in accordance with an embodiment in the present disclosure. The method includes determining 802 dimensions of a segment of the wellhead that is adapted to include the inverted diffuser. A further step in the method is machining 804, based at least in part on the dimensions, at least two releasable sections to include, on individual first sides of the at least two releasable sections, a vertical inner surface and a inclined inner surface relative to the vertical inner surface. Alignment of the at least two releasable sections may be verified in sub-process 806. Machining may be repeated via at least sub-process 808 if required. The method includes drilling 808 one or more channels into an individual second side of at least one of the at least two releasable sections and threading 810 the one or more channels to receive one or more releasable fasteners.

From all the above, a person of ordinary skill would readily understand that the tool of the present disclosure provides numerous technical and commercial advantages, and can be used in a variety of applications. Various embodiments may be combined or modified based in part on the present disclosure, which is readily understood to support such combination and modifications to achieve the benefits described above.

What is claimed is:

1. An inverted diffuser comprising:

at least one first section one or more channels supporting one or more releasable fasteners between the at least one first section and a wall of a wellhead or of a wellsite equipment; and at least one second section to be press-fitted or fastened adjacent to the at least one first section, the at least one first section and the at least one second section of the inverted diffuser to receive and to enable mixing of slurry components.

2. The inverted diffuser of claim 1 further comprising:

one or more side surfaces provided on the at least one second section to enable the press-fitting of the at least one second section with the at least one first section within the wellhead or the wellsite equipment.

3. The inverted diffuser of claim 1 further comprising:

a segment for associating with the wellhead, the segment comprising one or more second channels for supporting the one or more releasable fasteners from an outer surface of the segment to the at least one first section.

4. The inverted diffuser of claim 3 further comprising:

one or more bolts forming the one or more releasable fasteners and adapted to thread within the one or more channels so that individual heads of the one or more bolts are partly within the one or more second channels.

5. The inverted diffuser of claim 4 further comprising:

one or more pressure sensors releasably coupled to the one or more second channels with respective gaps maintained between the one or more pressure sensors and a respective one or more of the individual heads.

6. The inverted diffuser of claim 5 further comprising:

a monitoring sub-system to determine a degradation of the at least one first section or the at least one second section based in part on measurements of a pressure within one or more of the respective gaps.

7. The inverted diffuser of claim 1, wherein the at least one first section and the at least one second section comprise a carbide coating on one or more inner surfaces.

8. The inverted diffuser of claim 1, wherein the at least one first section and the at least one second section comprise hardened surfaces to resist abrasive features of the slurry components through the inverted diffuser.

9. The inverted diffuser of claim 1, further comprising:

a vertical inner surface and an inclined inner surface in the at least one first section and the at least one second section to support the mixing of the slurry components.

10. A method for application of an inverted diffuser in a wellhead or a wellsite equipment comprising:

placing a first one of the at least two releasable sections into the wellhead or the wellsite equipment;

placing a second one of the at least two releasable sections into the wellhead or the wellsite equipment adjacent to the first one of the at least two releasable sections; and fastening the first one of the at least two releasable sections to a wall of the wellhead using one or more releasable fasteners within one or more channels of the first one of the at least two releasable sections, the at least two releasable sections to receive and to enable mixing of slurry components within the inverted diffuser.

11. The method of claim 10 further comprising:

press-fitting or fastening the second one of the at least two releasable sections with the first one of the at least two releasable sections.

12. The method of claim 10 further comprising:

providing a segment of the wellhead for comprising the inverted diffuser; and drilling one or more second channels for supporting the one or more releasable fasteners from an outer surface of the segment to the one or more channels of at least the first one of the at least two releasable sections.

13. The method of claim 12 further comprising:

associating one or more pressure sensors releasably within the one or more second channels.

14. The method of claim 13 further comprising:

monitoring, using a sub-system associated with the one or more pressure sensors, pressure within the one or more second channels; and determining a degradation of at least one of the two releasable sections based in part on the pressure being outside a threshold.

15. The method of claim 14 further comprising:

replacing or resurfacing at least one of the two releasable sections based in part on a determination that the at least one of the two releasable sections has degraded more than a threshold that is monitored in part by a pressure change of an associated pressure sensor.

16. A method for manufacturing an inverted diffuser for a wellhead comprising:

determining dimensions of a segment of the wellhead that is adapted to comprise the inverted diffuser to receive and to enable mixing of slurry components therein;

machining, based at least in part on the dimensions, at least two releasable sections;

drilling one or more channels into an individual second side of at least one of the at least two releasable sections; and threading the one or more channels to receive one or more releasable fasteners.

17. The method of claim 16 further comprising:

machining the at least two releasable sections to individually comprise at least one second dimension that is lesser than one of the dimensions of the segment so that the at least two releasable sections fit within the segment.

18. The method of claim 16 further comprising:

machining an individual one of the at least two releasable sections to press-fit with the other one of the at least two releasable sections that comprises the one or more channels.

19. The method of claim 16 further comprising:

drilling one or more second channels through the segment, individual channels of the one or more second channels adapted to receive one or more bolts at least partly through the individual channels and adapted to receive one or more pressure sensors extending from the one or more channels with a gap between the one or more pressure sensors and respective individual heads of the one or more bolts.

20. The method of claim 16 further comprising:

drilling one or more second channels into another individual second side of another one of the at least two releasable sections; and threading the one or more second channels to receive one or more second releasable fasteners.

* * * * *